US005823129A

United States Patent [19]

Barnes, Jr.

[11] Patent Number: 5,823,129

[45] Date of Patent: Oct. 20, 1998

[54] METHOD OF UPHAULING A WINDSURFER

[76] Inventor: R. MacDonald Barnes, Jr., 930 Hillside Ave., Plainfield, N.J. 07060

[21] Appl. No.: 807,173

[22] Filed: Feb. 27, 1997

Related U.S. Application Data

[63] Continuation-in-part of Ser. No. 681,530, Jul. 22, 1996, abandoned.

[51] Int. Cl.[6] ..... B63B 15/00

[52] U.S. Cl. ..... 114/39.2; 114/90

[58] Field of Search ..... 114/39.1, 39.2, 114/89, 90, 97, 98, 102, 103, 104, 105, 106, 107, 108, 109

[56] References Cited

U.S. PATENT DOCUMENTS

| | | | |
|---|---|---|---|
| 4,418,631 | 12/1983 | Frobach | 114/39 |
| 4,674,428 | 6/1987 | Weber et al. | 114/39 |
| 4,763,591 | 8/1988 | Taylor | 114/39.2 |
| 4,938,161 | 7/1990 | Blackmer | 114/39.2 |
| 4,993,339 | 2/1991 | Cooper et al. | 114/39.2 |
| 5,042,412 | 8/1991 | Fouch | 114/39.2 |
| 5,575,229 | 11/1996 | Blackmer | 114/39.2 |

FOREIGN PATENT DOCUMENTS

| | | | |
|---|---|---|---|
| 2306717 | 4/1975 | France . | |
| 2497171 | 12/1980 | France . | |
| 2540759 | 3/1977 | Germany | 114/39.2 |

*Primary Examiner*—Stephen Avila
*Attorney, Agent, or Firm*—Mathews, Collins, Shepherd & Gould

[57] ABSTRACT

A method and apparatus for uphauling the sail of a windsurfer is provided. The method and apparatus for uphauling a sail uses the sailor's body weight to uphaul the sail. The apparatus connects between the windsurfer rig and a harness worn by the sailor. The uphaul line includes a means for shortening the length thereof to allow the sailor to adjust the length thereof during the uphaul process. The method includes attaching the uphaul line to the sailor, the sailor leaning in an opposite direction of the sail to use his or her body weight to uphaul the sail. Before the sailor loses his or her balance, the sailor grabs the conventional uphaul and steadies the rig. Then, the sailor moves his or her body forward and shortens the uphaul line. The sailor can then lean back again to continue uphauling the sail.

5 Claims, 10 Drawing Sheets

METHOD OF UPHAULING A WINDSURFER

RELATED APPLICATIONS

This application is a continuation-in-part application of U.S. patent application Ser. No. 08/681,530 by Barnes filed Jul. 22, 1996, now abandoned. The entire disclosure of this application is expressly incorporated herein by reference.

BACKGROUND OF THE INVENTION

1. Field of the Invention

This invention generally relates to a method and apparatus for uphauling a windsurfer sail, and more particularly to a sail uphaul apparatus that allows a sailor to use his or her body weight to raise, or "uphaul," a windsurfer sail.

2. Related Art

The sport of windsurfing utilizes a specialized surfboard, or "sailboard," having a mast that is mounted on the sailboard by means of a universal joint. A sail is interconnected with the mast, and a boom extends from the mast and about the sail. The entire mast, boom and sail assembly may be referred to as the "rig." The person who participates in the sport, hereinafter referred to as a "sailor," stands upon the sailboard, and while keeping his or her balance, manipulates the boom to angle the sail with respect to the direction of the wind to achieve propulsion by means of the force of the wind against the sail. If the rig is not held upright by the sailor, it will fall into the water. Often, because of the immediate sailing conditions, the sailor will be forced to let go of the rig, or the sailor will lose his or her balance and fall off the sailboard, allowing the rig to fall. The fallen sail and mast lie just below the surface of the water.

In order to raise the mast and sail, the sailor must exert a muscular effort to hoist or "uphaul" the rig from the surface of the water. Uphauling is normally accomplished with an uphaul apparatus, hereinafter "conventional uphaul," attached to the front of the boom at a point near the mast. A conventional uphaul is a knotted grip line that the sailor manually grabs and pulls, hand over hand, to uphaul the sail. The bottom of a conventional uphaul includes an elastic loop that extends about the bottom of the mast to retain the uphaul line against the mast when not in use and keep the bottom of the uphaul line on-board so that the sailor can reach it easily when the rig has fallen.

Due to the large surface area of the sail, the force of wind blowing over the sail, and water overlying the sail, the hoisting force required to uphaul the sail can exceed 100 pounds. Under these conditions, the sailor's back, arms and hands are subjected to strenuous muscular effort from uphauling. Uphauling greatly tires the sailor—much more than sailing.

One reason for the difficulty is that the uphaul line is attached at the boom. When the mast is erect, boom height (about shoulder height) is where one would want the top of the uphaul. But when the mast is lying prone on the water the sailor must hoist a 16 foot mast and sail with a rope which is attached 4 to 5 feet up the mast. The mounting of the uphaul to the mast at the boom causes negative leverage, that is it appears to the sailor that the mast and sail weighs more than it actually weighs. Therefore, the first 20 degrees of hoisting the mast (from horizontal, 0 degrees, to vertical, 90 degrees) is the most difficult. Once the mast rises above 20 degrees, or ¼ of the way up, the force required to raise it farther reduces rapidly.

While windsurfing, many sailors wear a harness around their hips, waist or chest. The harness includes a hook positioned in front of the sailor. Harness lines attached to the boom extend to and are attached, "hooked in," about the hook of the harness to take the force of the sail off of the sailor's back, arms and hands while sailing. Consequently, sailing becomes an exercise in balancing the sailor's weight against the force of the wind upon the sail.

In summary, sailing requires little effort, but uphauling the sail requires great effort. This tends to restrict the sport to stronger participants. The fatigue resulting from uphauling limits the time a sailor can continue to sail. Also, if the wind increases or the waves increase, or if the sailor gets tired far from shore, the exertion of uphauling could cause a serious safety problem. The sailor becomes fatigued and falls more often, high winds and waves increase the force required to uphaul the sail, and the exertion of uphauling more often increases the sailor's fatigue to the point of exhaustion so that he or she can not control the windsurfer to sail back to shore.

Examples of previous efforts at sail uphaul apparatus for uphauling a windsurfer sail and mast include: Fouch, U.S. Pat. No. 5,042,412 (1991) discloses a device for righting a fallen windsurfer sail and mast having a rope that is threaded through a pulley affixed to a point along the mast and above the boom. One end of the rope is attached to a harness about the sailor's torso. The other end of the rope is unattached to any physical point on the windsurfing rig. Both the rope and pulley act as a means for leveraging the muscular efforts of the sailor. When pulling on the unattached end of the rope, the sailor is able to raise the mast and its attached sail from the water using less effort than if no pulley mechanism was provided.

Cooper et al., U.S. Pat. No. 4,993,339 (1991) discloses an assembly for righting a fallen windsurfer sail and mast. The assembly includes, but is not limited to, two pulleys. One pulley is affixed upon the mast near the front of the boom and is threaded with an uphauler line. The uphauler line is a rope having both its ends terminate in a single small loop that is to be attached to the sailor's harness whenever it is necessary to right the sail. The second pulley is attached near the lower end of the mast and threaded with an elastic cord having one end tied to a stationary point upon the mast and its other end just below the single small loop which terminates the uphauler line. While the elastic cord is of sufficient size and length to pull the uphauler line against the mast when the uphauler line is not required to right the windsurfer, the cord has sufficient elasticity to stretch for a length long enough to permit the uphauler line to be hooked to the sailor's harness when the fallen sail is to be raised from the water. To right the windsurfer, the sailor grasps one side of the large loop formed just below the upper pulley by the uphauler line, and exerts a muscular effort which, when aided by the pulleys, rights the sail.

Blackmer, U.S. Pat. No. 4,938,161 (1990) discloses an apparatus for righting a mast and sail of a windsurfing rig. The apparatus has a hoisting pole, whose bottom end may, in one embodiment, be attached a point near the bottom of the mast. The hoisting pole's top end contains a halyard mechanism for directing the forces applied to the three attached ropes extending about the windsurfing rig. In the preferred embodiment, the other end of the first rope is connected to the front of the boom at a point upon the mast. The other end of the second rope is loose so as to be graspable by the sailor. The third rope connects the bottom end of the hoist pole to the front of the boom to redirect the axial force component on the hoist pole caused by the hoisting forces on the boom head. By pulling on the unattached end of the second rope, the sailor is able to right the fallen mast and sail. Once the rig's mast is in the proper position, the sailor can initiate the retraction of the hoist pole to its storage position beneath the front of the boom, by lifting the uphaul so as to allow the rig's elastic cords to carry the pole in the absence of any tension provided by the ropes attached to the halyard mechanism.

Taylor, U.S. Pat. No. 4,763,591 (1988) discloses an adjustable harness line that is to be attached to the boom of a windsurfing rig. The line utilizes a predetermined length of plastic tubing that is sufficiently flexible to bend under its own weight while avoiding entanglement on the boom during wind gusts. Attached to the plastic tubing are Velcro strap assemblies which are quickly and easily attached and detached from the boom, and a pull down power strap having a hand loop upon which the sailor can pull down to shorten the harness line.

Weber et al., U.S. Pat. No. 4,674,428 (1987) discloses a flexible wishbone shaped boom for a windsurfing rig that allows the sailor to vary the curvature of the sail while the rig is in motion. Each side of the boom has a flexible member attached to a rigid member. A flexible cross line connects the two flexible members and is the means by which the user can adjust the shape of the boom. Pulling on the cross line brings the two flexible members closer together and increases the overall length of the boom. Upon being lengthened, the boom's aft section moves to reduce the curvature of the sail. A harness, worn about the torso of the sailor, can use a hook-like device to engage the cross line and adjust its length so that the movement and body weight of the sailor may be utilized for the purpose of adjusting the boom length.

Frohbach, U.S. Pat. No. 4,418,631 (1983) discloses an apparatus for a windsurfing rig that aids the sailor in counterbalancing the force generated by the wind. The apparatus includes a handle member which is attached to the boom by a pair of connecting rods that are mounted near the handle's ends. The connecting rods are pivotally mounted to the boom so as to permit an angular displacement and rigidly attached to the handle. While the handle member is free to angularly move about the boom's axis, the connecting rods prevent the handle from linear movement along the boom's axis. By allowing the sailor to lean further into the wind than is permitted by a conventional windsurfing rig, the apparatus makes it possible for the sailor further reduce the effective area of the sail.

Ameil, French Pat. No. 80 276557 discloses a harness for a windsurfing rig having a strap to apply the sail action to the sailor's back and shoulders, leaving the sailor's arms free. The harness includes a belt that, at its ends, is affixed to the wishbone shaped boom. The sailor can press on the belt with his or her back while a separate return strap ensures permanent contact to the sailor's back.

Biasini, French Pat. No. 2575720 presents a lever which attaches to the mast base and gives the sailor better leverage when raising the fallen sail. The uphaul line extends from the boom, over the end of the lever, and the sailor pulls on the free end of the line. This reduces the effort required to uphaul the sail.

Frank, German Pat. No. 3004780 presents a strut which attaches to the mast foot and which is elastically attached at the top so that when the sailor pulls on the uphaul line the strut deploys and reduces the effort required to pull up the fallen sail.

None of these previous efforts disclose all the benefits and advantages of the present invention, nor do these previous patents teach or suggest all of the elements of the present invention. However, these inventions demonstrate an unmet need, the need to uphaul the sail of a windsurfer with less effort.

OBJECTS AND SUMMARY OF THE INVENTION

It is a primary object of the present invention to provide a sail uphaul apparatus that reduces the effort required to uphaul a windsurfer sail. All prior efforts in this area utilize levers or pulleys to reduce the effort required to pull with the hands, arms and back and raise the sail. The present invention achieves the same result with minimal muscular exertion on the part of the sailor. The sailor does not pull with the hands, arms or back. The sailor leans backwards and the body weight causes the sail to rise.

It is another object of the present invention to provide a method for uphauling a windsurfer sail that reduces the effort required to uphaul a windsurfer sail. The method includes using the uphaul apparatus of the present invention and leaning with the body to allow body weight to provide the lifting force.

It is another object of the present invention to provide an apparatus that is light weight and uses minimal space when not in use.

It is another object of the present invention to provide an apparatus that is easy to manufacture.

It is another object of the present invention to provide an apparatus which fits all sizes of sailors, and which can be re-sized for different sailors easily at the beach or on the water without the use of tools, knots, splicing or other cumbersome methods.

It is another object of the present invention to provide an apparatus that can be shortened in use as the sail is being raised by a sailor who employs the method presented herein.

Three apparatus are presented, although other devices for uphauling a sail by application of the sailor's body weight, are within the scope of the invention.

The first apparatus provides an uphaul line having a loop (or other means) at the top end for securing to the front of the boom (or to the mast), and having a loop at the free end for attaching to the sailor's harness (or other means of attaching to his or her person). See FIGS. 3*a*, 3*b*, and 3*c*.

The second apparatus provides an uphaul line having a loop at the top end, a loop at the free end, and one or more additional loops positioned between the free end and the top end. Multiple loops enable the sailor to shorten the line as the sail is being raised, by attaching the loop at the free end to the sailor's harness and then progressively attaching the harness to loops further up the line. This is a simple variation of apparatus 1 above. See FIGS. 4*a*, 4*b*, and 4*c*.

A third apparatus provides an uphaul line having a loop at the top end, and a means for forming and retaining a loop at the free end for attaching to the sailor's harness. By reforming the loop the sailor can shorten the length of the line as the sail is being raised. This is a variation of apparatus 1 and 2 above which is variable in use to any length, as opposed to apparatus 2 which is step-wise variable in length according to the position of the loops. See FIGS. 5*a*, 5*b*, 5*c*.

These and other objects of the present invention are achieved by the method and apparatus of the present invention for uphauling the sail of a windsurfer using the sailor's body weight to uphaul the sail. There are three apparatus described herein. All three are based on the main principle, which is that the sailor can be connected to the boom and use his or her body weight to effect raising the fallen sail. This principle is novel because it is not in use prior to this application. This principle is non-obvious because many have tried before to reduce the effort required to raise a windsurfer sail, but have not invented this method.

All three of the apparatus connect between the windsurfer rig and a harness worn by the sailor. The method includes attaching the uphaul line to the sailor, the sailor leaning in an opposite direction of the sail to use his or her body weight to uphaul the sail. When the sailor has leaned back as far as possible the sail will be about 20 to 25 degrees above horizontal (or about one quarter of the way up towards vertical). At this point the difficult part of raising the sail will have been accomplished. Depending on which of the three apparatus the sailor is employing, the sailor now does the following to finish raising the rig.

If the sailor is using apparatus 1, with one loop at the free end, the sailor now grasps the apparatus and finishes raising the rig by shortening the line manually, hand over hand, until the sailor's hands are at the top and the rig is now vertical.

If the sailor is using apparatus 2, with a loop at the free end and intermediate loops between the free end and the top, the sailor grasps the apparatus to steady the rig (not to hoist it further upwards, but to keep it from lowering). Then the sailor bends his or her knees (lowering his or her waist) and moves his or her body forward, and attaches the harness to the next loop up the fine. This effectively shortens the line, now the sailor leans back again and uses his or her body weight to further raise the sail to about 45 degrees above horizontal (or ½ way up). The sailor can repeat this method to the next loop. By then the sail is almost fully raised and the sailor's hands will be at the top of the uphaul apparatus, ready to grab the boom and sail away.

If the sailor is using apparatus 3, with a loop forming mechanism at the free end, the sailor grasps the apparatus to steady the rig. Then with one hand on the apparatus, the sailor bends his or her knees and moves his or her body forward, causing the line to slacken. Now the sailor adjusts the loop forming means to shorten the line. Then the sailor leans back again and uses his or her body weight to further raise the sail to about 45 degrees above horizontal. The sailor can then repeat this step until the rig is fully raised.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

Figure 1A:
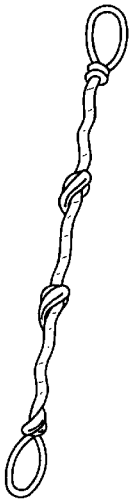
FIG. 1*a* shows a conventional uphaul which is in common use today.
Figure 1B:
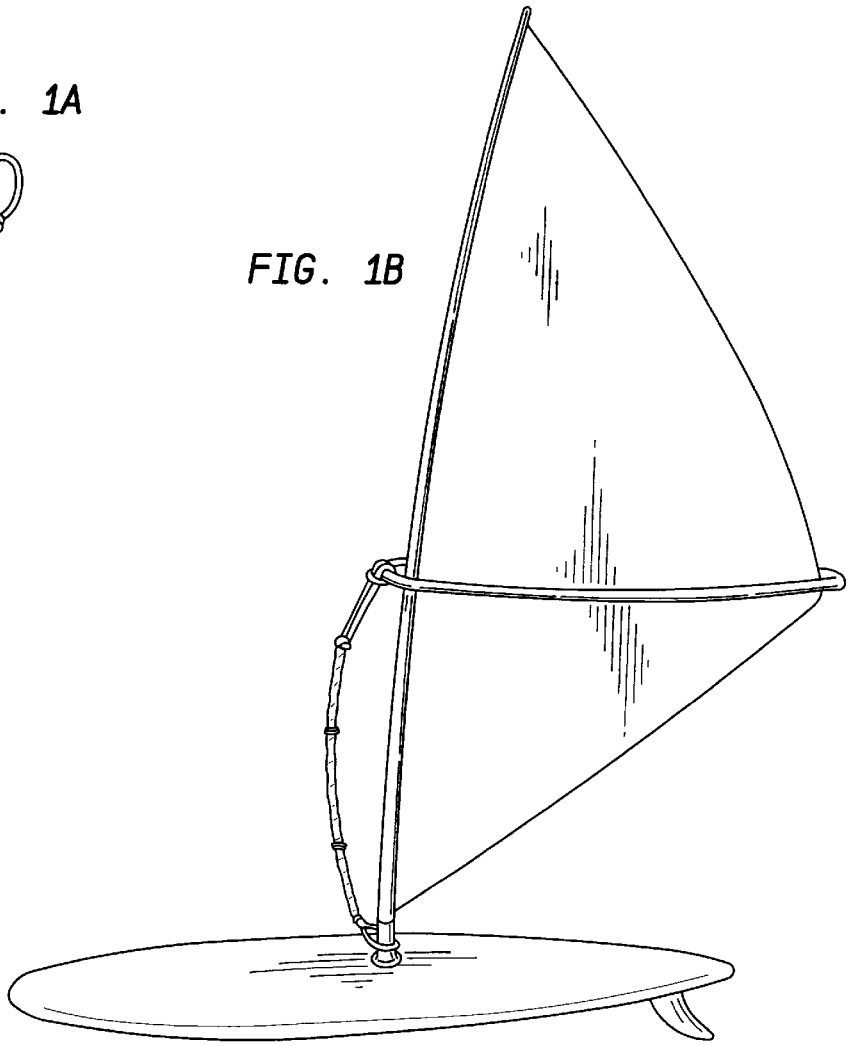
FIG. 1*b* shows a conventional uphaul rigged in position on a sailboard.
Figure 1C:
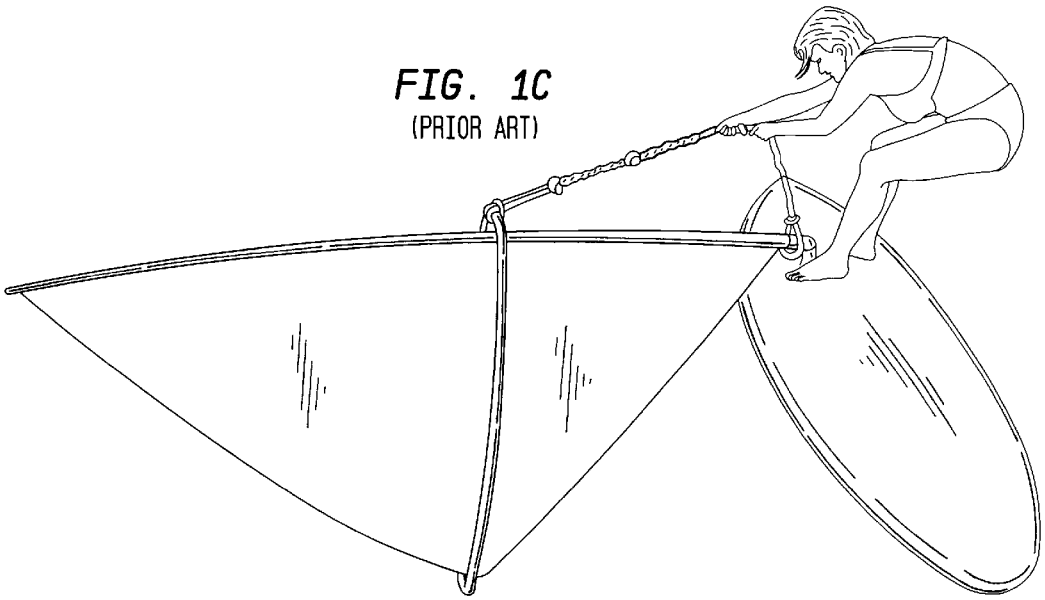
FIG. 1C (PRIOR ART)
FIG. 1*c* is shows a sailor using a conventional uphaul to raise a windsurfer sail.

The present invention relates to a new uphaul apparatus and method for uphauling a windsurfer sail. The traditional uphaul is a simple knotted line. The knotted line in use at the present is made from a length of tubular webbing with a length of elastic shock cord inside, shown in FIGS. 1*a*, 1*b* and 1*c*. This combination allows the sailor to uphaul the sail hand over hand by grasping the knotted tubular webbing. And when not in use the elastic cord causes the webbing to snap to the mast, staying out of the way until needed.

As mentioned above, a number of inventions have been developed and patented to reduce the effort required to uphaul the sail by using pulleys and levers. We believe that this invention is novel because the sailor uses body weight, not manual effort or reduced manual effort, to raise the sail.

Figure 2:
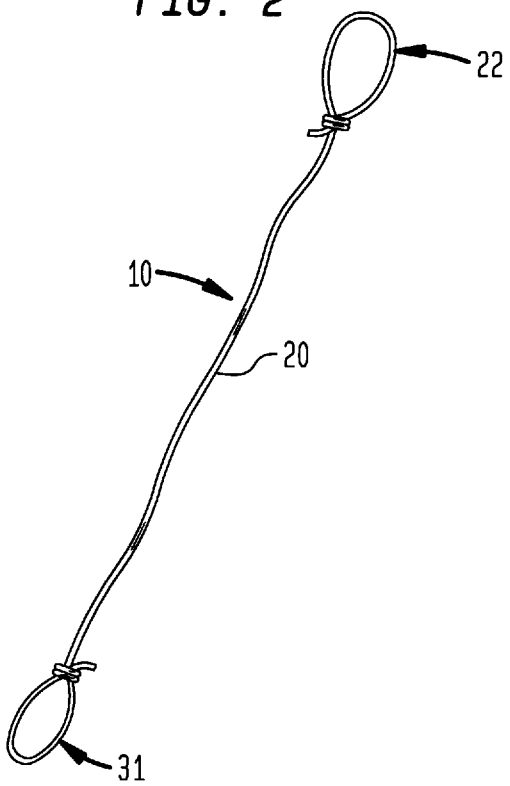
FIG. 2 shows the simplest form of the present invention, a common rope.

Three implementations of this invention are herein presented, moving from the simplest to the more complex. As shown in FIG. 2, the simplest form of the present invention, generally indicated at 10, comprises a line 20, which is nothing more than a basic rope, having a loop 22 at the top end thereof for attachment to the front of a boom (or to a mast), and a loop 31 at a lower or free end to attach to the sailor's harness. This common rope with a loop at each end, which would not be a novel or non-obvious by itself, when connected to a windsurfing rig, allows the sailor to raise the rig using body weight instead of the muscular effort of hands, arms and back.

Figure 3A:
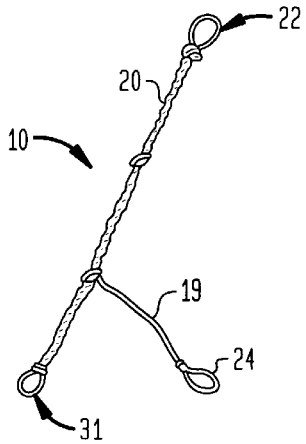
FIG. 3*a* is a diagram of apparatus 1 of the present invention.
Figure 3B:
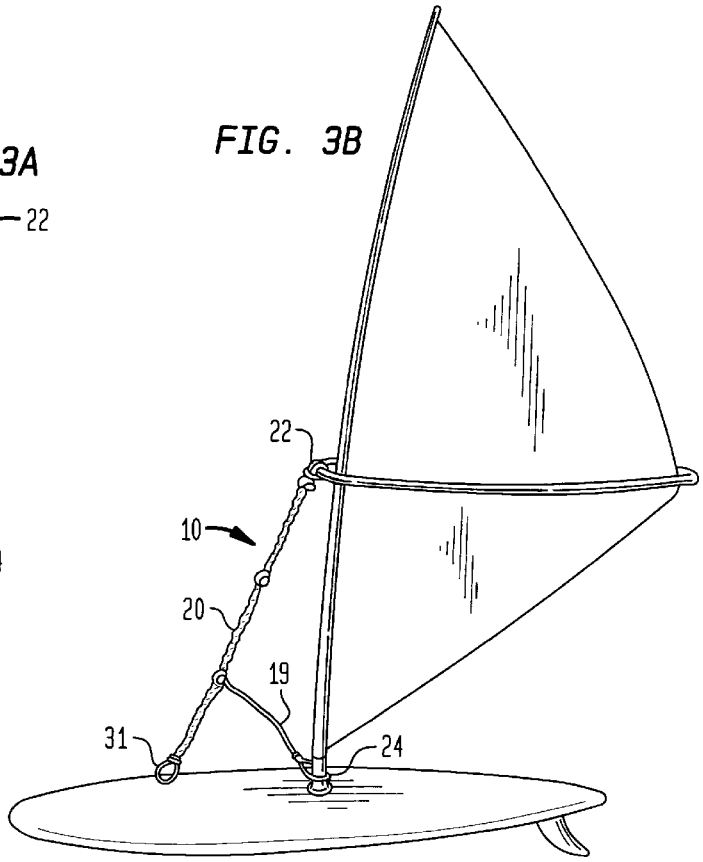
FIG. 3*b* shows apparatus 1 rigged in position on a sailboard.
Figure 3C:
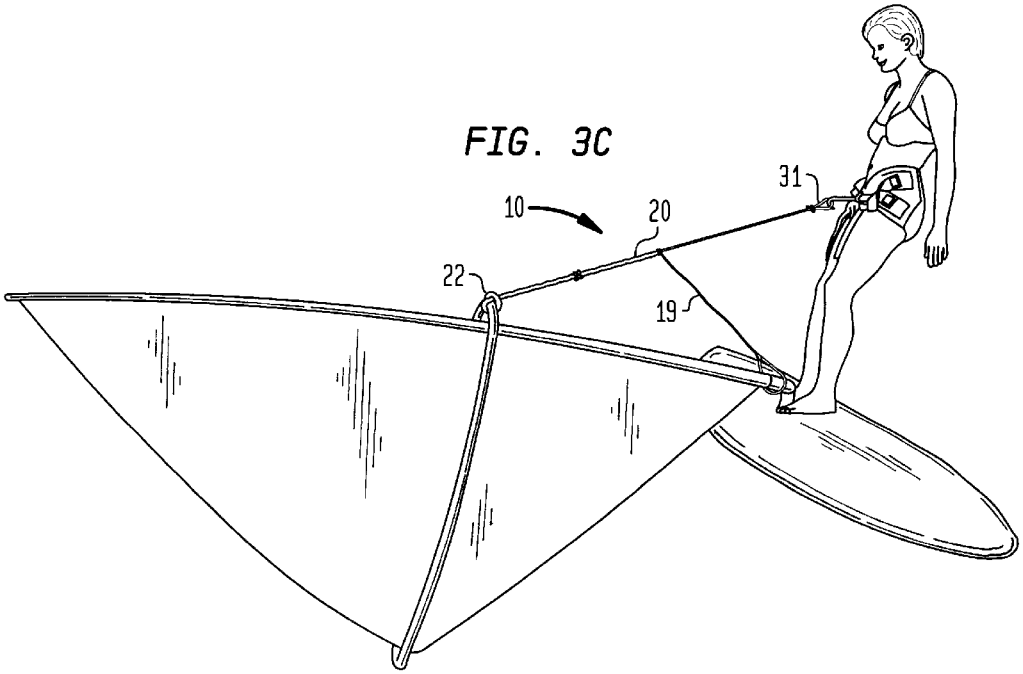
FIG. 3*c* is shows a sailor using apparatus 1 to raise a windsurfer sail.

FIGS. 3*a*, 3*b* and 3*c* show the common rope 20 of FIG. 2 with the incorporation of a length of tubular webbing and a length of shock cord 19 terminating in a lower loop 24, so that when not in use, it snaps against the mast like a rubber band, staying out of the way until needed. We call this apparatus 1. The sailor attaches the loop at 31 to his or her harness, then the sailor leans back and partially raises the sail using only his or her body weight to do the work of raising the sail. Then the sailor grasps apparatus 1 and then finishes raising the sail with the conventional manual method, hand-over-hand. Because the force required to raise the sail is greatest when the sail is flat on the water, and because the force required to continue raising the sail diminishes rapidly as the sail rises, the simple apparatus 1 saves the sailor significant exertion. (It should be pointed out that line 20 can be connected to the rig and/or to the sailor by means of loops as herein described, or by any other suitable means known in the art.) The method which is being patented, and the related apparatus which is being patented, is that the sailor can raise the fallen sail by connecting himself to the mast and leaning backwards.

Figure 4A:
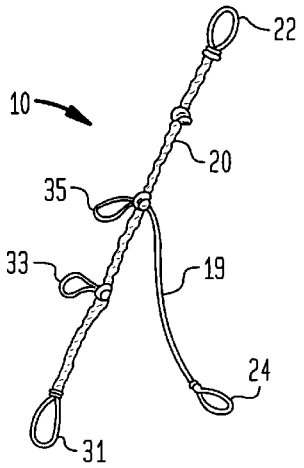
FIG. 4*a* is a diagram of apparatus 2 of the present invention.
Figure 4B:
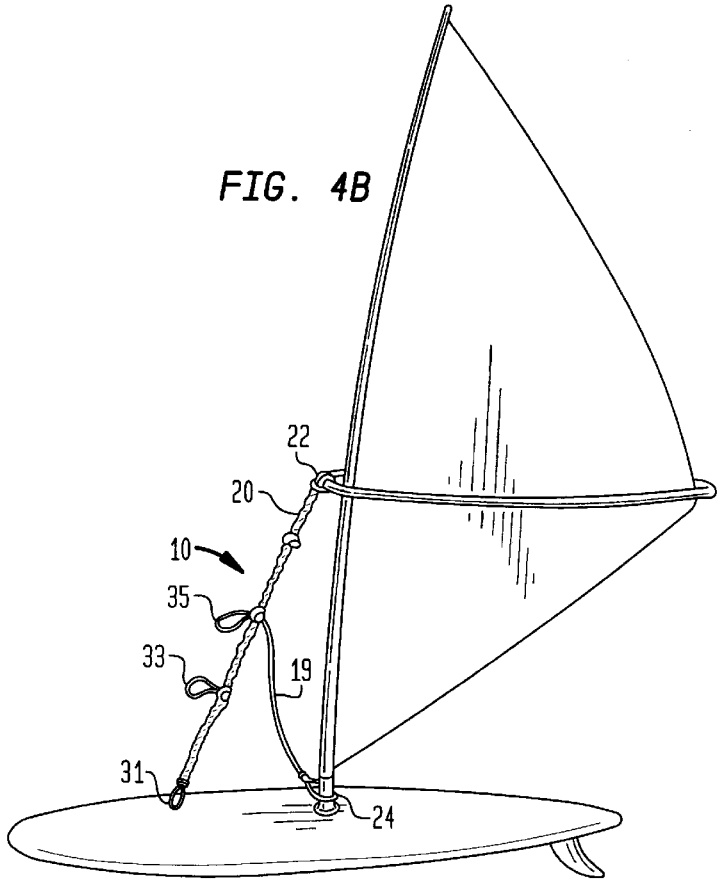
FIG. 4*b* shows apparatus 2 rigged in position on a sailboard.
Figure 4C:
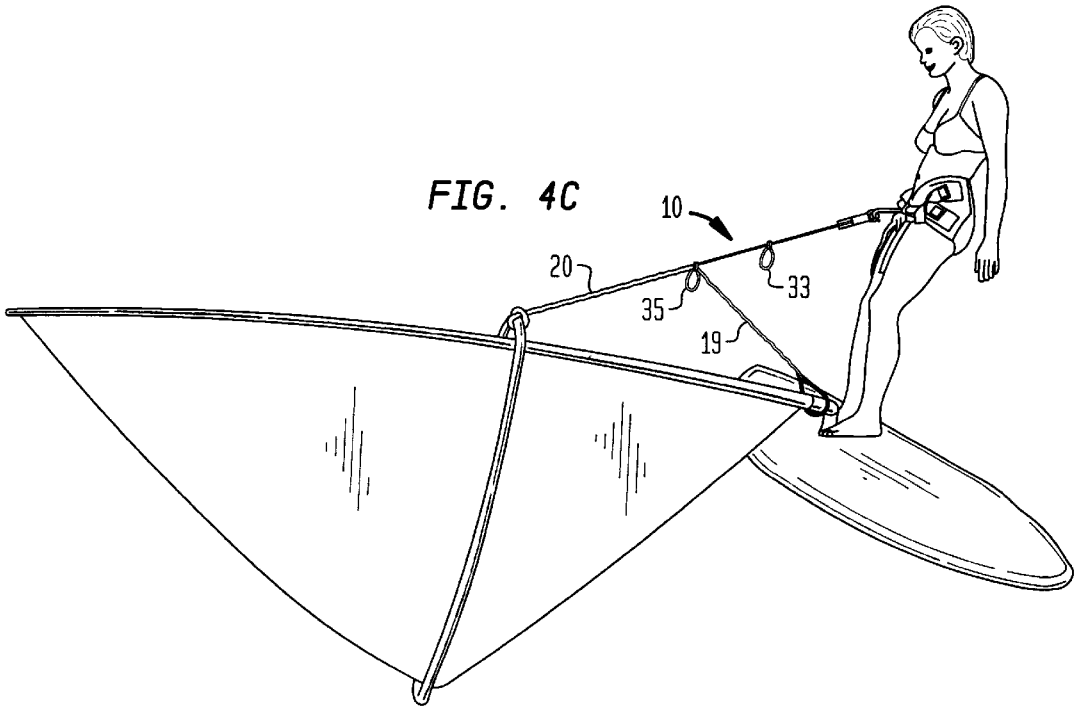
FIG. 4*c* is shows a sailor using apparatus 2 to raise a windsurfer sail.

In order to allow the sailor to continue using the method of the present invention for raising the sail we developed apparatus 2, shown in FIGS. 4*a*, 4*b* and 4*c*. After using the loop 31 at the free end of apparatus 2 to raise the sail about ¼ of the way up from horizontal towards vertical, the sailor can now grasp apparatus 2 and remove the end loop 31 from his or her harness hook and insert the harness hook into the second loop 33. This effectively shortens the length of the line 20 and the sailor again leans back to raise the sail some more, or to about ½ way up. This step may now be repeated again from loop two 33 to loop three 35, and by now the sail is about ¾ of the way up towards vertical and the sailor finishes by hand. (There may be any number of loops and the loops may be placed in various locations between the bottom and the top of apparatus 2).

Figure 5A:
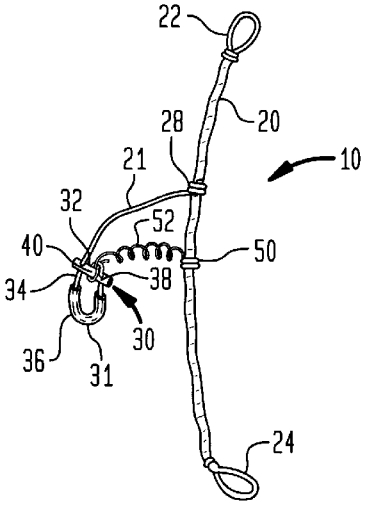
FIG. 5*a* is a diagram of apparatus 3 of the present invention.
Figure 5B:
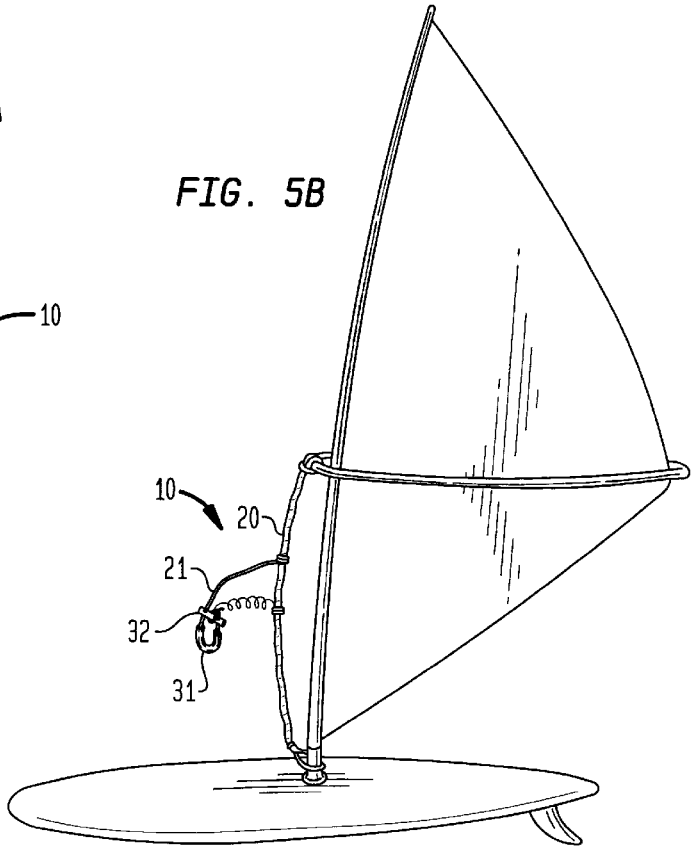
FIG. 5*b* shows apparatus 3 rigged in position on a sailboard.
Figure 5C:
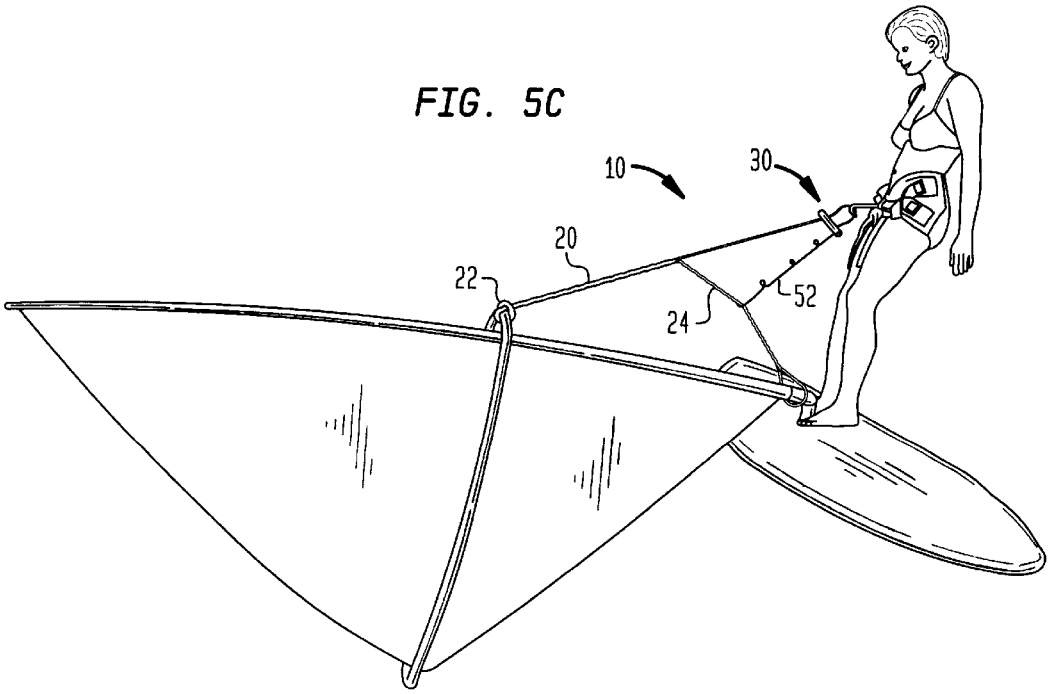
FIG. 5*c* is shows a sailor using apparatus 3 to raise a windsurfer sail.

In apparatus 3, shown in FIGS. 5*a*, 5*b* and 5*c*, a means 30 is provided to set the length of the line 20 to any length desired by the sailor. The means comprises a handle 32 which forms a loop 31 in a line 20 connected to the uphaul. By moving the handle 32 up and down the line 21, the sailor adjusts the length of the line 21. To raise the sail, the sailor sets the line 21 to its maximum length and leans back as with apparatus 1 and apparatus 2. After raising the sail partially, the sailor grasps the line 21 and moves his or her body forward causing the line 21 to slacken. Now the sailor slides the handle 32 up the line 21 to remove the slack and shorten the line 21. The sailor then leans back again to raise the sail some more. The sailor can continue this process until the sail is fully raised. The difference between apparatus 2 and apparatus 3 is that in using apparatus 3, the sailor is not limited by the placement of the fixed loops, he can create a line of any desired length.

Figure 6A:
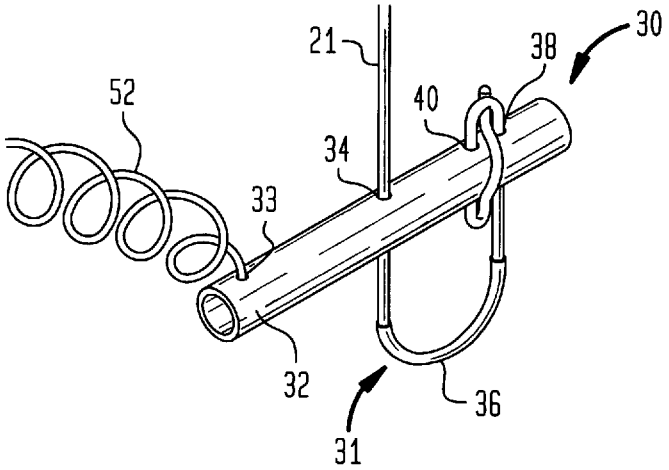
FIG. 6*a* shows the loop forming mechanism of apparatus 3, without tension on the loop.
Figure 6B:
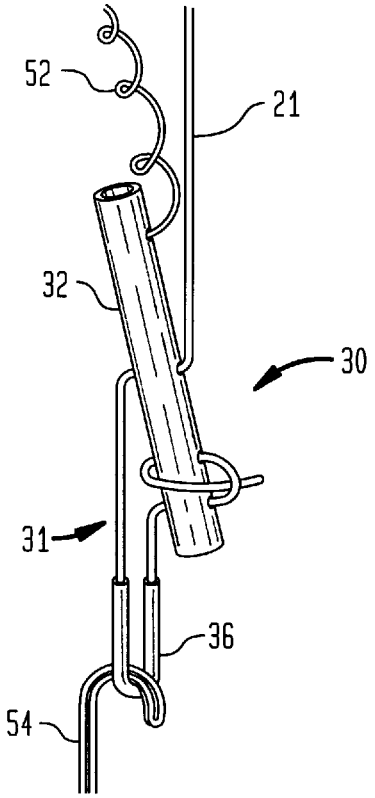
FIG. 6*b* shows the loop forming mechanism of apparatus 3, with tension on the loop.

FIGS. 6A and B, 7A and B, 8A and B, and 9, all show different embodiments of the adjustment means 30 for adjusting the size of the loop 31 and accordingly, the length of the line 20. In FIGS. 6A and B, the arm 32 comprises a tube with apertures 33, 34, 38, and 40 therein for coacting with line 21 to adjustably form loop 31. When a force is applied to the loop 31, the bracket pivots to kink the line, and lock in the position of the bracket and the size of the loop.

Figure 7A:
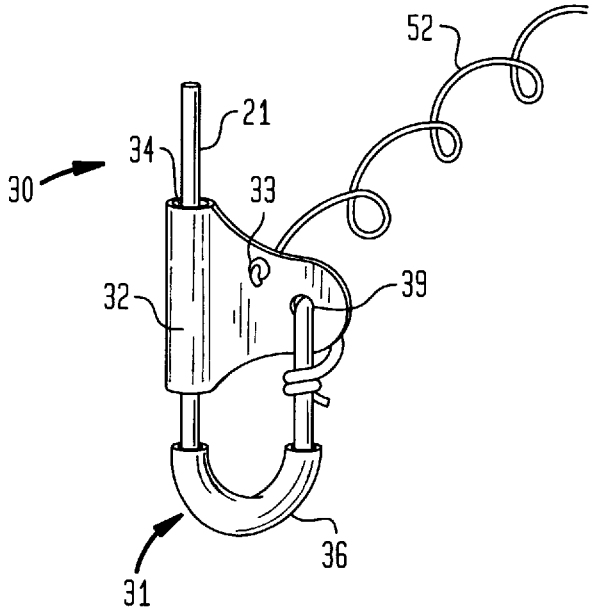
FIGS. 7A and 7B are partial perspective views of another embodiment of the adjustment mechanism for the uphaul apparatus of the present invention.
Figure 7B:
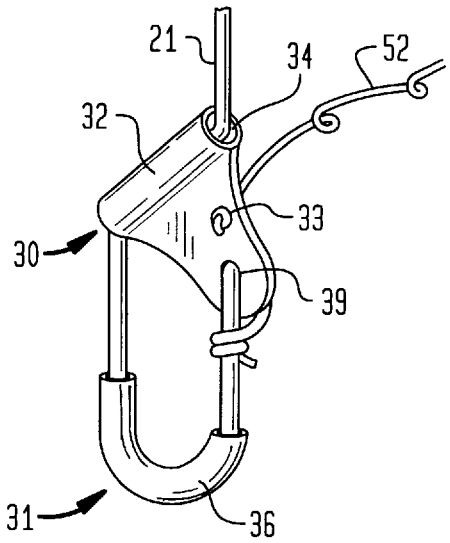

In FIGS. 7A and B, the arm 32 comprises a bracket with aperture 34 for the line 21, aperture 33 for the elastic cord 52, and aperture 39 whereat the end of line 21 can be tied off. When a force is applied to the loop 31, the bracket pivots to kink the line, and lock in the position of the bracket and the size of the loop.

Figure 8:
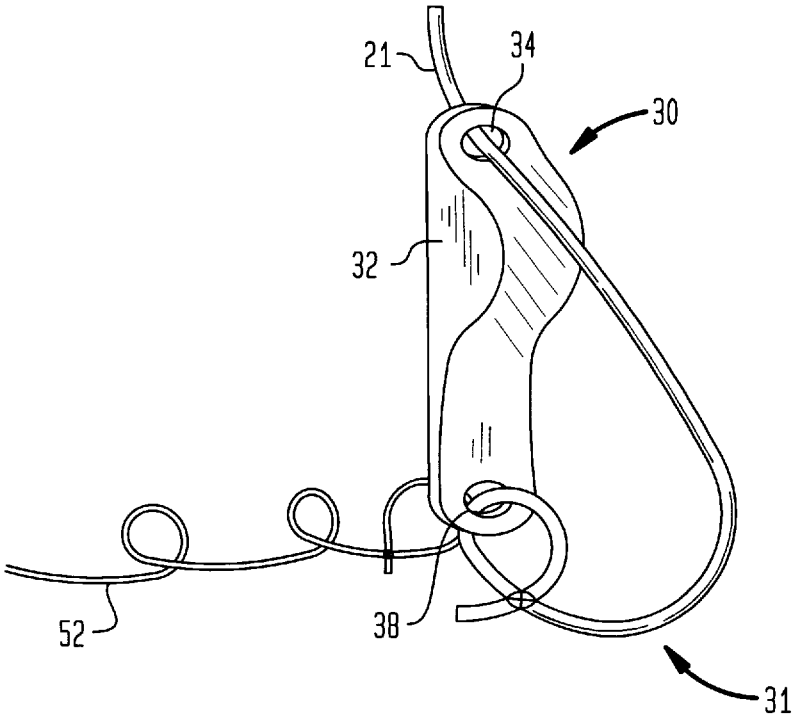
FIGS. 8 is a partial perspective view of another embodiment of the adjustment mechanism for the uphaul apparatus of the present invention.

In FIGS. 8A and B, the arm 32 comprises a block with aperture 34 for the line 21, aperture 33 for the elastic cord 52, and apertures 38 and 39 for tying off the end of line 21. When a force or harness pulley or hook 54 is applied to the loop 31, the arm pivots to kink the line, and lock in the position of the tube and the size of the loop. As herein previously set forth, any other adjustment means known in the art or hereinafter developed can be used in connection with the present invention.

Figure 9:
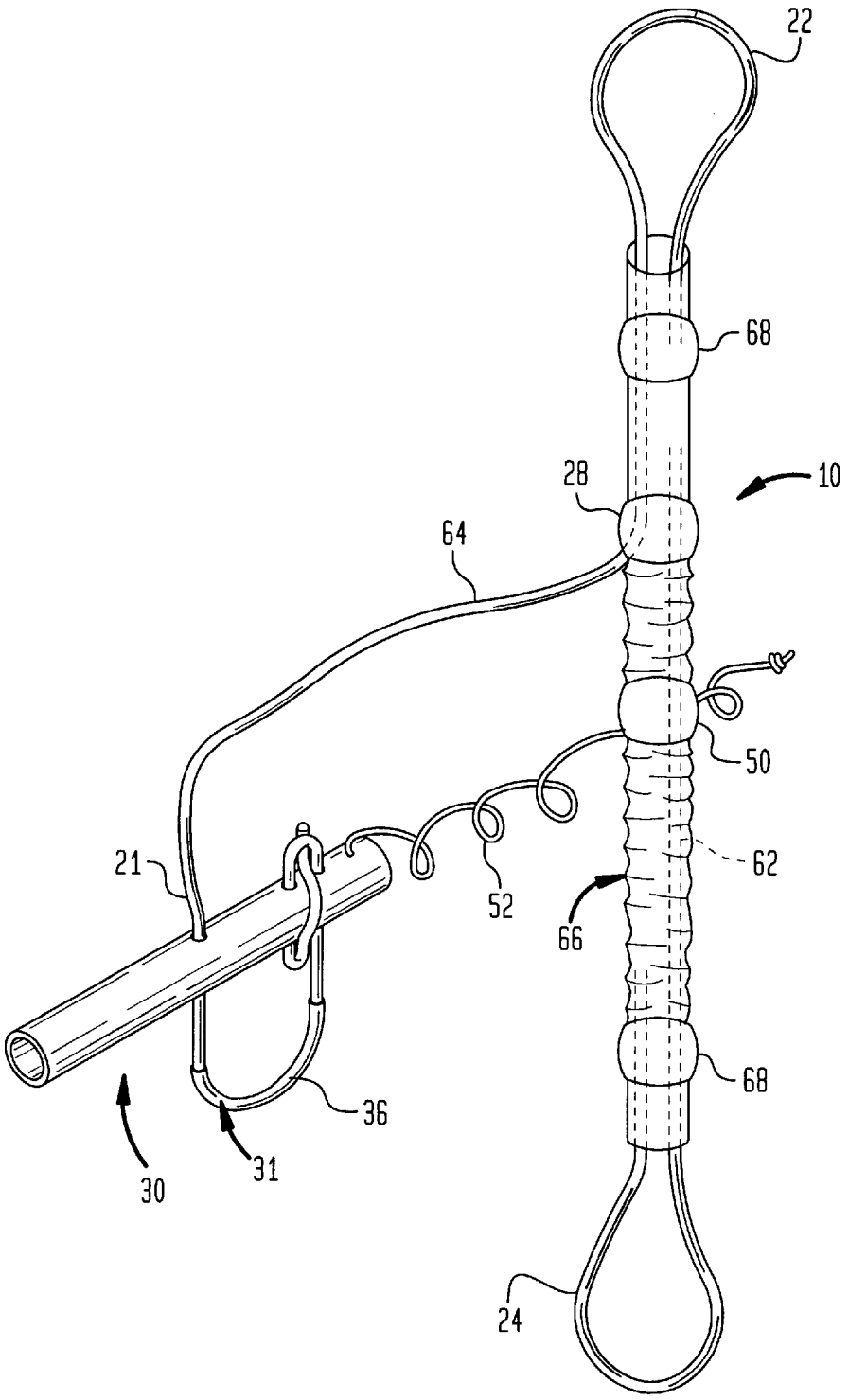
FIG. 9 is a partial perspective view of another embodiment of the adjustment mechanism for the uphaul apparatus of the present invention.

In FIG. 9 the arm 32 comprises a v-shaped locking device 32, commonly known in the industry as a jam cleat having interior facing surfaces with ridges formed thereon. The line 21 engages within the v-shaped surfaces and tension applied to the line pulls the line further into the locking device to lock the line. The line can be freed by backing the line out of the locking device to facilitate adjusting the length of line. Importantly, any other means known in the art for adjustably locking down a line to adjust the length thereof is within the scope of the present invention and can be employed in practicing the present invention.

Figure 10:
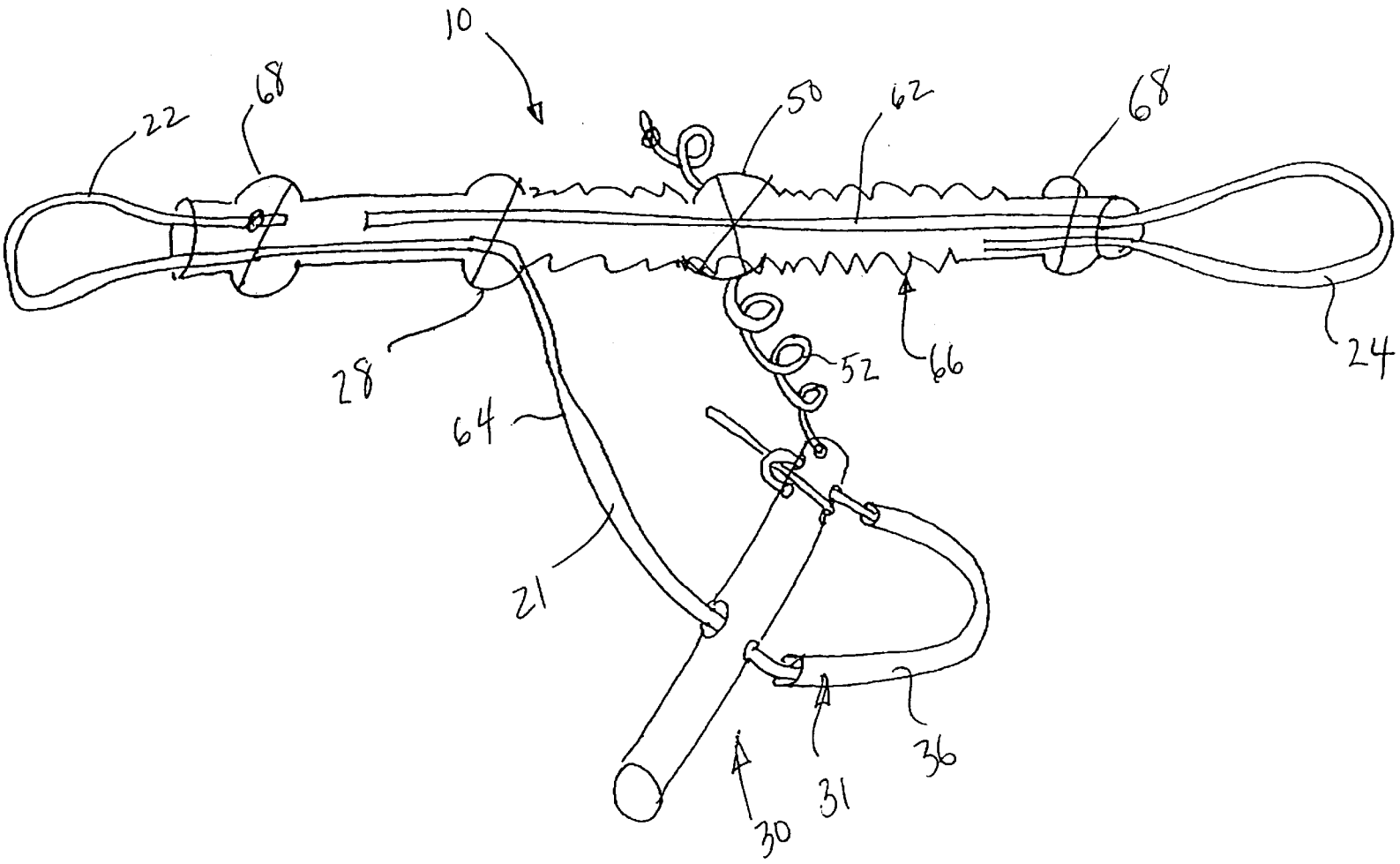
FIG. 10 is a partially cut away view of the uphaul shown in FIG. 3.

Referring now to FIG. 10, the components of the uphaul of the present invention can be seen. The uphaul 10 includes upper loop 22 formed of a second line 64 comprising rope or other material, and lower loop 24 formed of a first line 62 comprising elastic or other stretchable material. First and second lines 62 and 64 are contained within a flexible sheath 66 with loops 22 and 24 emerging therefrom. Line 64 emerges from sheath 66 at knot 28 to form adjustable line 21. Elastic cord 52 interconnects with sheath 66 at knot 50. Knots 68 form loops 22 and 24 and interconnect same with sheath 66. It should be pointed out, however, that FIG. 10 only shows one of many possible configurations of the uphaul of the present invention.

In summary, the combined method and apparatus of the present invention serves to eliminate the exertion of uphauling the sail and it keeps the uphaul line stowed when not in use. It also keeps the uphaul line on-board when the rig falls into the water. Additionally, the method and apparatus of the present invention automatically re-sets itself after use in so far as the adjustment means is effective under tension, but when the mast is raised, and the adjustment means is released, the adjustment means slacks off and gravity serves to pull the adjustment means down the uphaul line to the fully extended state ready for re-use.

Having thus described the invention in detail, it is to be understood that the foregoing description is not intended to limit the spirit and scope thereof What is desired to be protected by Letters Patent is set forth in the appended claims.

What is claimed is:

1. A method of uphauling a sail of a windsurfer rig comprising the steps of:

providing an uphaul line;

attaching a first end of the line to the windsurfer rig;

attaching a second end of the line to an article worn by a sailor;

providing an intermediate attachment means on the line for attaching the line to the article at an intermediate position along the line;

applying the sailor's body weight to the line by the sailor leaning in an opposite direction from the windsurfer rig to partially uphaul the windsurfer rig;

then grasping the line manually and the sailor moving his or her body towards the rig;

attaching the intermediate attachment means to the article worn by the sailor; and re-applying the sailor's body weight to the line and therefore to the windsurfer rig, by the sailor again leaning in an opposite direction of the rig to further uphaul the windsurfer rig.

2. The method of claim 1 further comprising the steps of manually grasping the uphaul line to maintain the rig in a partially uphauled position; the sailor moving his or her body towards the rig; providing a second intermediate attachment means between the intermediate attachment means and the first end; attaching the second intermediate attachment means to the article; and applying the sailor's body weight to the line and therefore to the windsurfer rig, the sailor leaning in an opposite direction of the windsurfer rig to continue to uphaul the windsurfer rig.

3. A method for a sailor to uphaul a fallen windsurfer rig, the method comprising the steps of:

providing an uphaul line having a first end and a second end having an attachment means;

attaching the first end of the line to the windsurfer rig;

attaching the second end of the line to the sailor by attaching the attachment means at the second end of the line to an article worn by the sailor;

applying body weight to the line and therefore to the windsurfer rig by the sailor leaning in an opposite direction of the fallen windsurfer rig so that the body-weight may be used to raise the windsurfer rig out of the water without use of force from the hands or the arms, and then the sailor moving toward the windsurfer rig, shortening the length of the line, and leaning back again to further uphaul the rig, wherein the step of shortening the length of the uphaul line comprises the step of removing the attachment means at the end of the line from the article, and re-attaching the article to a second attachment means formed inward of the second end of the line.

4. A method for uphauling a sail of a windsurfer rig, the rig being coupled to a sailboard, the method comprising the steps of:

providing an uphaul line having a first end and a second end, the second end having an attachment means for attaching the line to an article worn by a sailor;

fitting the uphaul line prior to using the device by adjusting the length of the uphaul line so that, when the sailor stands on the sailboard with the fallen rig lying in the water, attaches the second end of the line to the article worn by the sailor, and begins to lean in the direction opposite the rig, the uphaul line will fit tautly between the rig and the article;

attaching the first end of the line to the windsurfer rig;

attaching the second end of the line to the sailor by attaching the attachment means to the article worn by the sailor; and applying the sailor's body weight to the line and therefore to the windsurfer rig by the sailor leaning in an opposite direction of the fallen windsurfer rig to pull the line taut between the sailor and the windsurfer rig so that the sailor may use his or her bodyweight to raise the windsurfer rig out of the water.

5. The method of claim 4, further comprising the step of shortening the length of the line after the initial leaning back, wherein the step of shortening the length of the uphaul line comprises grasping an adjustment means, moving the adjustment means along the line to shorten the line and then continuing to uphaul the sail using the shortened line.

* * * * *

UNITED STATES PATENT AND TRADEMARK OFFICE

CERTIFICATE OF CORRECTION

PATENT NO. : 5,823,129

DATED : October 20, 1998

INVENTOR(S) : Barnes, Jr.

It is certified that error appears in the above-identified patent and that said Letters Patent is hereby corrected as shown below:

On the title page, Item [54] and Column 1, title should read,

Item [54], title should read --METHOD OF UPHAULING A WINDSURFER SAIL--.

Column 6, delete lines 17-19.

Column 6, line 20, change "9" to --8--.

Column 6, line 20, change "10" to --9--.

Column 7, line 47, after "loop 31." insert --Aperture 34 is for the line 2, aperture 33 for the elastic cord 52, and apertures 38 and 39 for tying off the end of the line 21.--.

Column 7, line 48, delete "the bracket" and insert --such as with a harnes pulley or hook 54, the arm--.

Column 7, line 42, delete "8A and B, and 9" and insert --and 8--.

Column 7, delete lines 56-64.

UNITED STATES PATENT AND TRADEMARK OFFICE

CERTIFICATE OF CORRECTION

PATENT NO. : 5,823,129

DATED : October 20, 1998

INVENTOR(S) : Barnes, Jr.

It is certified that error appears in the above-identified patent and that said Letters Patent is hereby corrected as shown below:

Column 7, line 65, change "9" to --8--..

Column 8, line 9, change "10" to --9--.

Column 8, line 19, change "10" to --9--.

Delete drawing sheet 10.

Signed and Sealed this

Fourth Day of May, 1999

*Attest:*

Q. TODD DICKINSON

*Attesting Officer*

*Acting Commissioner of Patents and Trademarks*